United States Patent [19]

Burt

[11] 4,443,013

[45] Apr. 17, 1984

[54] HAND RACKET FOR BALL GAME WITH SIGNAL-GENERATING MEANS

[76] Inventor: Johanna Burt, 2 Hillside Crescent, New Rochelle, N.Y. 10804

[21] Appl. No.: 401,260

[22] Filed: Jul. 23, 1982

[51] Int. Cl.[3] ..... A63F 9/00

[52] U.S. Cl. ..... 273/318; 273/67 R

[58] Field of Search ..... 273/67 R, 73 R, 67 B, 273/26 A, 330, 331, 318, 319, 320, 321, 326, 331, 374, 375, 376, 381, 348, 340

[56] References Cited

U.S. PATENT DOCUMENTS

| | | | |
|---|---|---|---|
| 545,327 | 8/1895 | Weston | 273/374 |
| 3,367,661 | 2/1968 | Dean | 273/374 |
| 4,222,563 | 9/1980 | Heftler et al. | 273/374 |

OTHER PUBLICATIONS

"Air Volley", The Sporting Goods Dealer, Jun. 1977, p. 43.

*Primary Examiner*—Richard C. Pinkham
*Assistant Examiner*—Matthew L. Schneider
*Attorney, Agent, or Firm*—Karl F. Ross

[57] ABSTRACT

A hand racket for a ball game has a frame with two concentric rings interconnected by several spokes, the inner ring having a diameter exceeding that of a ball to be bounced off a net of strings spanning that ring. The two rings are separated by spaces whose width exceeds the ball diameter and which enable the gripping of the outer ring by the hands of a player whose aim is to let the descending ball hit the net without striking the frame or dropping through one of the intervening spaces. The rings and the spokes are tubular and, except at two handle-forming locations of the outer ring, are provided with resiliently depressible cover strips closing a circuit for the actuation of a sound generator when the frame is being hit by the ball. The frame may be provided with a ball launcher to be used at the beginning of a round.

6 Claims, 5 Drawing Figures

HAND RACKET FOR BALL GAME WITH SIGNAL-GENERATING MEANS

FIELD OF THE INVENTION

My present invention relates to a game of skill played with a hand racket designed to intercept a ball which is to be repeatedly bounced into the air or batted toward another player.

BACKGROUND OF THE INVENTION

U.S. Pat. No. 3,507,494 discloses a racket of this type with a tubular frame of substantially square outline spanned by a net or strings. A player using that racket grips its frame at two locations for receiving a ball and hitting it back. The ball may strike the net at any point and may also be bounced off the frame.

OBJECT OF THE INVENTION

The object of my present invention is to provide a racket of the same general type which enables a player, an opponent or an umpire to distinguish between a "fair" ball striking a designated area of the racket and a "foul" ball hitting its frame, thereby calling for the exercise of greater skill on the part of the player.

SUMMARY OF THE INVENTION

A hand racket according to my invention comprises a circular pad whose diameter exceeds that of the ball being used. The pad is concentrically surrounded by a frame which includes an inner ring encircling the pad, an outer ring separated from the inner ring by an annular clearance whose width exceeds the ball diameter, and a plurality of radial spokes in that clearance interconnecting the two rings. A signal generator on the frame, such as a battery-operated bell, buzzer or similar sound emitter, is triggerable by pressure-responsive means extending over at least a major part of the frame when that part is struck by the ball, thereby indicating an improper interception to the player or to an observer. The relatively wide separation of the two rings lets a ball pass through when it misses the pad.

According to a more particular feature of my invention, the pressure-responsive means may comprise mobile upper wall portions of the rings and the spokes. These mobile wall portions advantageously terminate short of a pair of handle-forming locations on the outer ring so that the signal generator is not triggered by the hands of a player gripping the frame at these locations.

The pad may comprise a net of strings spanning the inner ring but could also be in the form of a solid disk, e.g. of plywood or plastic material.

BRIEF DESCRIPTION OF THE DRAWING

The above and other features of my invention will now be described in detail with reference to the accompanying drawing in which.

SPECIFIC DESCRIPTION

Figures 1, 2, 3, 4, 5:
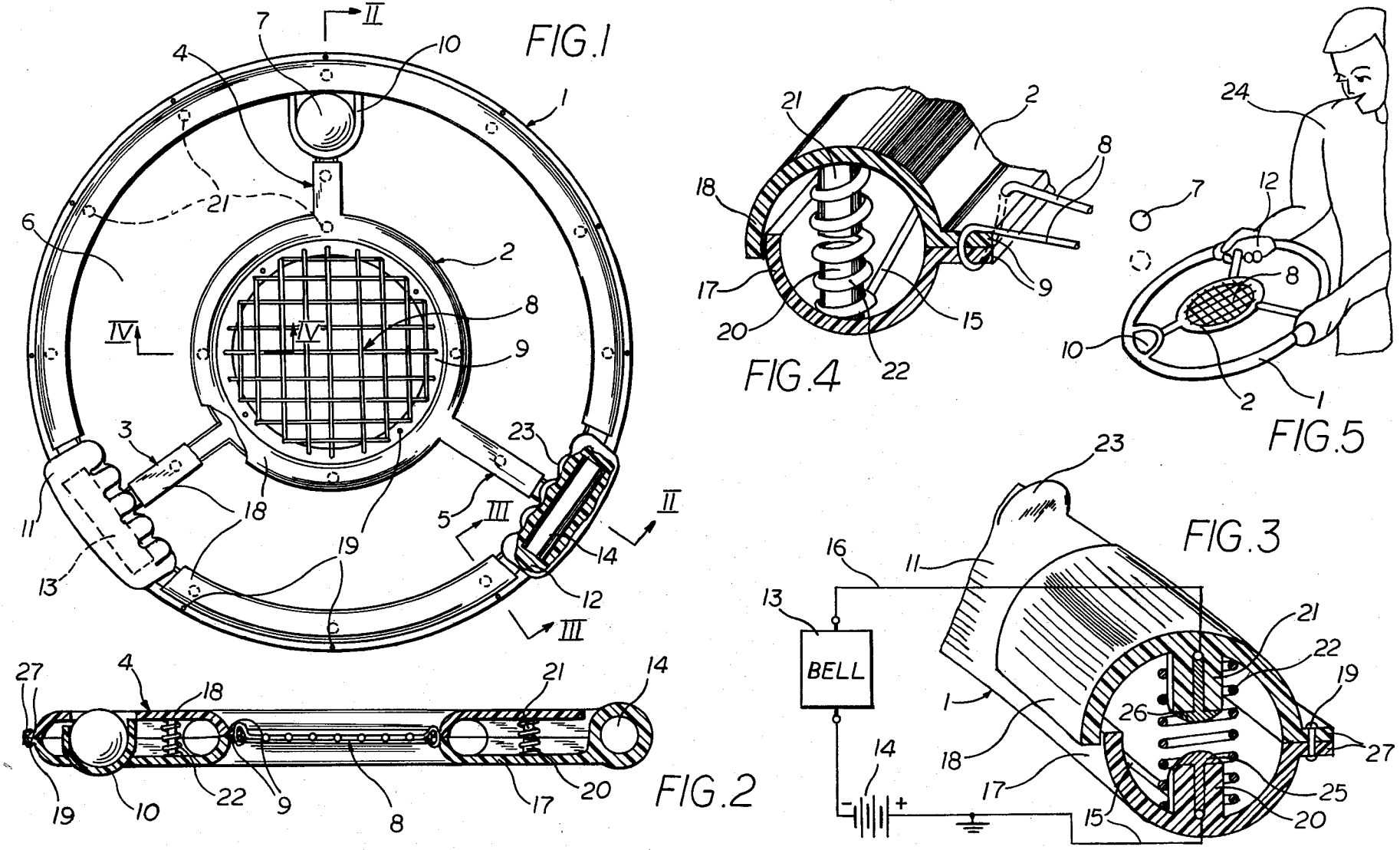
FIG. 1 is a top view, partly in section, of a hand racket according to my invention.
FIG. 2 is a cross-sectional view taken on the line II—II of FIG. 1.
FIG. 3 is a fragmentary and enlarged perspective view of an outer ring of the racket frame, partly in section on the line III—III of FIG. 1, also showing diagrammatically an associated signal generator.
FIG. 4 is a view similar to that of FIG. 3 but taken on the line IV—IV of FIG. 1, showing part of an inner frame ring.
FIG. 5 is a perspective view, drawn to a smaller scale, of the racket held by a player.

The racket shown in the drawing comprises a frame of synthetic resin formed from a tubular outer ring 1 and a tubular inner ring 2 interconnected by three radially extending, peripherally equispaced tubular spokes 3, 4 and 5 of the same kind of material. The two rings are separated from each other by three sectoral gaps 6 whose width exceeds that of a ball 7 and closely approaches the inner diameter of ring 2. That ring is spanned by a pad 8 designed as a net of elastic strings anchored to a pair of inner flange 9 which are interconnected by rivets 19 and are integral with a lower and an upper tube half 17, 18 slightly overlapping each other. The outer ring 1 and the spokes 3–5 also consist of such tube halves, ring 1 having external flanges 27 likewise interconnected by rivets 19.

As seen in FIGS. 1 and 2, spoke 4 is provided with an upwardly open socket 10 serving as a launcher from which the ball 7 can be propelled into the air at the beginning of a round in which, for example, a player 24 (FIG. 5) has to bounce that ball back from pad 8 of the racket as many times in succession as possible. Two handles 11 and 12 on the outer ring 1 facilitate the gripping of the frame by the player.

A signal generator included in the racket comprises a bell 13 energizable by a battery 14, both indicated schematically in FIG. 3. As shown in FIG. 1, bell 13 can be conveniently accommodated in the finger-gripping portion or handle 11 while battery 14 is replaceably held in the other finger-gripping portion 12. The operating circuit for the bell comprises conductors 15 and 16 extending in parallel to a multiplicity of lower and upper electrical contacts 25, 26 which are respectively lodged in bosses 20, 21 integral with tube halves 17 and 18 of rings 1, 2 and spokes 3–5. Pairs of such bosses 20, 21 and contacts 25, 26 are disposed at a multiplicity of locations in both rings and all three spokes, the bosses of each pair being urged apart by an associated spring 22 as seen in FIGS. 2–4. The combined biasing force exerted by springs 22 and the elasticity of the tube material, however, is so low that contacts 25, 26 of any pair will close whenever the ball 7 strikes the upper tube half 18 in their vicinity. In that event, of course, bell 13 will be sounded as an indication of a "foul" ball. Tube halves 18 terminate short of socket 10 and of handle portions 11, 12 so as not to trigger the sound generator 13, 14 when the ball is launched or when the player grips the racket.

Thus, a player can easily distinguish between a hit, defined as an interception of the ball by the net 8, and a miss, occurring when the oncoming ball strikes any part of the frame or drops to the ground outside the frame or through its gaps 6. This distinction will apply both to a solo play, with the player bouncing the ball as often as possible into the air, and to a game between opponents batting the ball back and forth.

Handle portions 11 and 12 are shown provided with peripheral ridges 23 accommodating the fingers of the players between them.

I claim:

1. In a game of skill, the combination of a ball with a hand racket for bouncing said ball, said racket comprising:

a circular pad having a diameter exceeding that of said ball;

a frame concentrically surrounding said pad, said frame including an inner ring encircling said pad, an outer ring separated from said inner ring by an annular clearance whose width exceeds the diameter of said ball, and a plurality of radial spokes in said clearance interconnecting said rings;

signal-generating means on said frame; and pressure-responsive means extending over at least a major part of said frame for triggering said signal-generating means upon said frame being struck by the ball.

2. A game as defined in claim 1 wherein said rings and said spokes are tubular, said pressure-responsive means comprising mobile upper wall portions of said rings and said spokes.

3. A game as defined in claim 2 wherein said mobile wall portions terminate short of a pair of handle-forming location on said outer ring.

4. A game as defined in claim 1 wherein said frame is provided with an upwardly open socket adapted to launch said ball into the air at the beginning of play.

5. A game as defined in claim 1 wherein said pad comprises a net of strings spanning said inner ring.

6. A game as defined in claim 1, 2, 3, 4 or 5 wherein said signal-generating means comprises a battery-operated sound emitter.

* * * * *